United States Patent [19]

Sasaki et al.

[11] Patent Number: 4,832,629

[45] Date of Patent: May 23, 1989

[54] CRIMP-STYLE TERMINAL

[75] Inventors: Toru Sasaki; Ryuetsu Oikawa, both of Shizuoka, Japan

[73] Assignee: Yazaki Corporation, Japan

[21] Appl. No.: 242,917

[22] Filed: Sep. 12, 1988

Related U.S. Application Data

[63] Continuation of Ser. No. 44,478, May 1, 1987, Pat. No. 4,775,339.

[30] Foreign Application Priority Data

May 1, 1986 [JP] Japan ..... 61-65136

[51] Int. Cl.[4] ..... H01R 11/01

[52] U.S. Cl. ..... 439/889; 439/883

[58] Field of Search ..... 439/623, 711, 720, 727, 439/763, 791, 793, 868, 883–889

[56] References Cited

U.S. PATENT DOCUMENTS

| | | | |
|---|---|---|---|
| 2,350,765 | 6/1944 | Johnson | 439/874 |
| 2,393,481 | 1/1946 | Smith | 439/793 |
| 3,428,938 | 2/1969 | Kulick | 439/791 |
| 4,354,726 | 10/1982 | Kato et al. | 439/763 |

OTHER PUBLICATIONS

Japanese Publication of Unexamined Utility Model Application Publication No. 51-40782.

*Primary Examiner*—Eugene F. Desmond
*Attorney, Agent, or Firm*—Wigman & Cohen

[57] ABSTRACT

A crimp-style terminal fixed to an electrical connection such as a bar of an electrical source together with the other terminal piled thereon with a screw includes first rotation preventing member for preventing a rotation of the crimp-style terminal about the electrical connection and second rotation preventing member for preventing a rotational movement of the other terminal about the crimp-style terminal when screwed. Said first rotation preventing member consists of a pair of first bent portions which are adapted to be engagement with the bar, and said second rotation preventing member consists of a pair of second bent portions bent to the opposite side to the first bent portions, which are adapted to regulate the rotational movement of the other terminal.

14 Claims, 2 Drawing Sheets

CRIMP-STYLE TERMINAL

This is a continuation of co-pending application Ser. No. 044,478 filed on May 1, 1987, U.S. Pat. No. 4,775,339.

BACKGROUND OF THE INVENTION

1. Field of the Invention

This invention relates to a crimp-style terminal, and in particular to an improvement in a crimp-style terminal which is used when the other terminals are piled thereon and they are fixed to a bar of an electrical source together by a screw, and which can prevent rotations of the terminals about the bar when screwed.

2. Description of the Prior Art

Conventionally, when a crimp-style terminal to which a wire is connected is fixed to an electrical connection such as a bar of an electric source with a screw, the screwing operation was conducted by grasping the wire with one hand in order to prevent a rotation of the terminal and screwing the screw with the other hand. Therefore, the fixing operation of the terminal was very troublesome.

In addition, in the conventional crimp-style terminal, there is a disadvantage that a rotation of the terminal with respect to the bar on the screw axis is liable to be caused easily by an unexpected external force acting on the wire of the terminal or a dead weight of the wire applying to the terminal after the terminal is fixed to the bar with the screw. Once the rotation is caused, the wiring direction of the wire is disordered and the wire is departed from a distributing area of it. Further, there is a risk that the screw will be loosened.

These disadvantages are also caused when the other terminal is piled on the crimp-style terminal and they are fixed to an electrical connection such as a bar of an electrical source together by a screw.

SUMMARY OF THE INVENTION

In view of the foregoing disadvantages in the conventional crimp-style terminal, this invention has been made. Accordingly, a main object of the present invention is to provide a crimp-style terminal which can prevent occurrence of rotations of terminals when the crimp-style terminal is fixed to an electrical connection such as a bar of an electrical source together with the other terminal piled thereof with a screw.

Another object of the present invention to provide a crimp-style terminal which can make its fixing operation to the bar easy when the other terminal is piled thereon and they are fixed to the bar together.

A further object of the present invention to provide a crimp-style terminal which can restrict wiring directions of the terminal and the other terminal piled thereon to a predetermined area so that the remaining area is utilized effectively.

A further object of the present invention is to provide a crimp-style terminal having rotation preventing means which is formed by press working easily.

In order to accomplish the objects, a crimp-style terminal fixed to an electrical connection together with the other terminal piled thereon by a screw according to the present invention comprises an electrical contacting section with an aperture for receiving the screw and a wire connecting section to which a wire is connected, first rotation preventing means for preventing a rotation of the terminal about the bar, and second rotation preventing mean for preventing a rotation of the other terminal. Said first rotation preventing means is adapted to be engagement with the both sides of the electrical connection, and said second preventing means is adapted to be engagement with the other terminal piled thereon.

According to the crimp-style cable terminal having the above structures, since the first rotation preventing means is engagement with the electrical connection, the rotation of the terminal about the connection can be prevented even when the screw is fastened. In addition, since the second rotation preventing means can restrict a rotational movement of the other terminal piled thereon within a predetermined area, the rotation of the other terminal is also regulated.

As a result, it is possible to prevent the rotations of the terminals when the screw is fastened, thereby the fixing operation of the terminals become easy. Further, even if an external force or dead weights of the wires act on the terminals after they are fixed, it is possible to prevent a looseness of the screw and an occurrence of a disorder of the wires of the terminals. Furthermore, since the rotation preventing means are very simple constructions, it is possible to form the terminal by press working of a metal sheet materials, thereby manufacturing cost will be reduced.

The above and other objects and advantages of the present invention will become more apparent in the following description and the accompanying drawings, in which;

DETAILED DESCRIPTION OF THE PREFERRED EMBODIMENT

Figure 1:
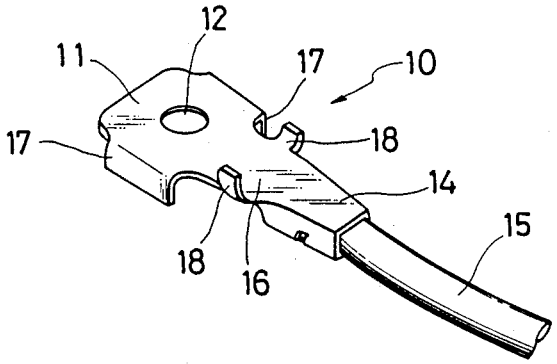
FIG. 1 is a perspective view of the first embodiment of a crimp-style terminal according to the present invention.

Referring to the drawings, the embodiments of the present inventions will be described.

Figure 2:
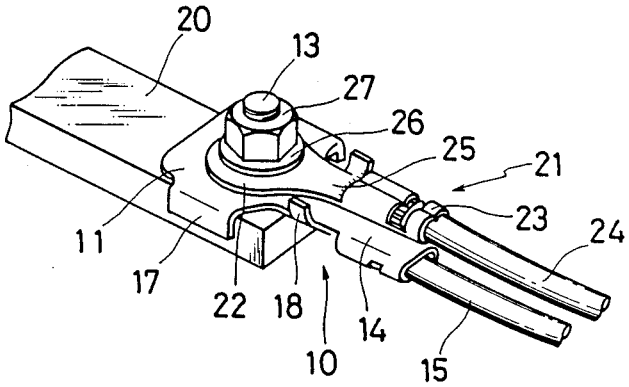
FIG. 2 is a perspective view which shows a condition that the other terminal is piled on the crimp-style terminal and they fixed to a bar of an electrical source.

FIGS. 1 and 2 show the first embodiment of a crimp-style terminal according to the present invention. The crimp-style terminal 10 includes an electrical contacting section 11 having a substantial fault square shape with an aperture 12 to which a fixing bolt 13 is inserted, a wire connecting section 14 to which a wire 15 is connected and an neck portion 16 formed between the electrical contacting section 11 and the wire connecting section 14. A first rotation preventing means for preventing a rotation of the terminal 10 with respect to a bar 20 of an electrical source (not shown) is exemplified by a pair of first bent portions 17. Said first bent portions 17 are formed by bending two elongated portions integrally provided on the both sides of the electrical contacting section 11 substantially at a right angle to the plane of the electrical contacting section 11, respectively. Further, a second rotation preventing means for preventing a rotation of the other terminal placed on the crimp-style terminal 10 is exemplified by a pair of second bent portions 18. Said second bent portions 18 are also formed by bending a pair of protruding portions integrally provided on the both sides of the neck portion 16 to the opposite direction to the first bent portions 17.

The width between the first bent portions 17 is slightly wider than that of the bar 20 of the electrical source, so that the electrical contacting section 11 of the terminal 10 is attached to the upper surface of the bar 19 so as to be engagement with the bar. As a result, the terminal 10 can be mounted to the bar 20 non-rotatably.

The crimp-style terminal according to the present invention may be formed by bending a metal sheet punched to a predetermined shape by press working.

On the terminal 10, the other terminal 21 is placed. Said terminal 21 comprises a flat electrical contacting section 22 with an aperture to which the fixing bolt 13 is inserted, an wire connecting section 23 to which an wire 24 is connected and a neck portion 25 provided between the electrical contacting section 22 and wire connecting section 23. Both terminals 10 and 21 are fixed to the bar 20 in piles by means of the fixing bolt 13 which is inserted through the apertures of the terminals 10 and 20, and a washer 26 and a nut 27 for screwing on to the bolt 13. In this case, the width between the second bent portions 18 is relatively wider than that of the neck portion 25 of the piled terminal 21. Therefore, the terminal 21 can be rotated about the axis of the bolt 13 to a certain extent, but the rotational movement of the terminal 21 is restricted within the predetermined angle by the second bent portions 18.

In this embodiment, it is preferable, as shown in FIG. 2, that the wire 15 is connected to the terminal 10 at the under surface of the wire connecting section 14.

In the use of the crimp-style terminal 10 of the first embodiment, at first the crimp-style terminal 10 is attached to the bar 20 of the electrical source by putting the electrical contacting section 11 on the end portion of the bar 20 so as to receive the bolt 13 embedded in the bar 20 to the aperture 12 and interpose the both sides of the end portion of the bar 20 between the first bent portions 17, so that the terminal 10 is mounted on the bar 20 non-rotatably. Thereafter, the other terminal 21 is placed on the terminal 10 so as to receive the bolt 13 in the aperture. Then, the nut 27 is fastened on to the bolt 13 through the washer 26. In this case, the terminal 10 does not turn about the bar 20 by virtue of the first bent portions 17, and the piled terminal 21 does not also turn over the predetermined angle defined by the second bent portions 18 when the nut 27 is fastened.

Accordingly, since the crimp-style terminal according to the present invention has the above structures, both the terminal 10 and the terminal 21 piled thereon are prevented to turn when the nut 27 is fastened. In addition, even if an un-expected external force or dead weight of the wires is applied to the terminals 10 and 21 after they are fixed, the terminal 10 and 21 do not rotate by virtue of the first and second bent portions 17 and 18, thereby the wiring directions of the wires can be arranged and the looseness of the nut 27 can be also prevented.

Figure 3:
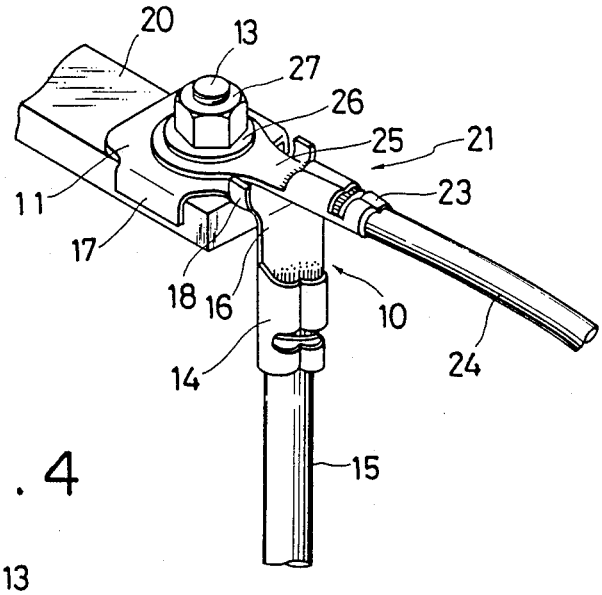
FIG. 3 is a perspective view which shows the other condition that the crim-style terminal is fixed to the bar together with the other terminal by the screw.

FIG. 3 shows the condition that the wire connecting section 14 of the crimp-style terminal 10 is bent downwardly substantially at a right angle at a position between the neck portion 16 and the wire connecting section 14. In this case, the wiring directions can be easily changed only by bending the wire connecting section 14 without harming the rotation preventing function of this invention.

Figure 4:
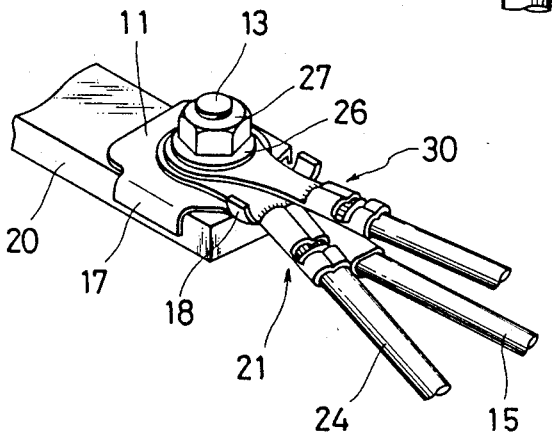
FIG. 4 is a perspective view which shows the other condition that the other two terminals are piled on the crimp-style terminal and they are fixed to the bar with a screw.
Figure 5:
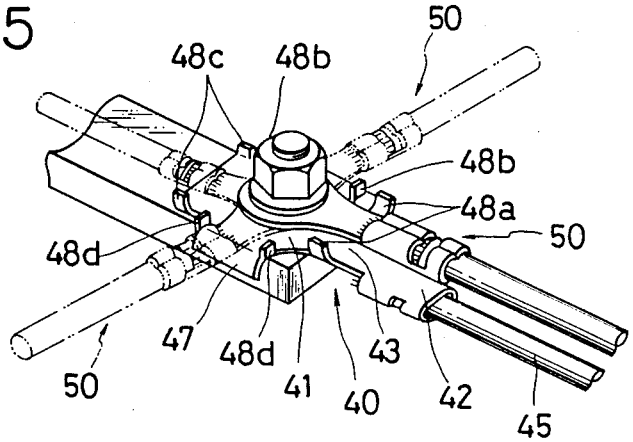
FIG. 5 is a perspective view of the other embodiment of a crimp-style cable terminal according to the present invention.

FIG. 4 shows the condition that two crimp-style terminals 21 and 30 are placed on the terminal 10, and they are fixed to the bar 20 with the bolt 13 and nut 27. In this case, the height of the second bent portions 18 must be higher than the total thicknesses of the two terminals 21 and 30 to prevent rotations of both terminals 21 and 30 by the second bent portions 17. FIG. 5 shows the second embodiment of the present invention. In this embodiment, a crimp-style terminal 40 has the substantially same structures as those of the crimp-style terminal of the first embodiment except for the structure of a electrical contacting section 41.

That is to say, the terminal 40 also comprises the electrical contacting section 41, a wire connecting section 42 to which a wire 45 is connected and a neck portion 43 formed between the electrical contacting section 41 and the wire connecting section 42. On the both sides of the electrical contacting section 41, there are provided a pair of bent portions 47, respectively, as the first rotation preventing means. On the both sides of the neck portion 43, there are provided a pair of bent portins **48*a*, respectively, for regulating dislocations of the other terminal piled thereon, as the second rotation preventing means. In the crimp-style terminal 40 of this invention, further three second rotation preventing means are provided on the electrical contacting section 41 at the both sides thereof and the opposite side to the neck portion 43. As shown in FIG. 5, these rotation preventing means are also consituted from a pair of bent portions 48*b*, 48*c* and 48*d* which are formed by bending a pair of protruding portions integrally formed on the electrical contacting section 41 to the opposite direction of the first bent portions 17**, respectively.

The terminal 40 of the second embodiment can be also formed by bending a metal sheet-punched to a prodetermined shape by press working.

In the terminal 40 having the above structures, since the four rotation preventing means **48*a*, 48*b*, 48*c* and 48*d* for the other terminals piled thereon are provided on each sides of the electrical contacting section 41, the other terminal 50 is connected from four directions as illustrated by imaginary lines in FIG. 5, thereby the wiring directions being not restricted. Further, the other four terminals can be connected to the terminal 10, if the bent portions 48*a*, 48*b*, 48*c* and 48*d*** has enough hight for the total thicknesses of the four terminals.

According to the crimp-style terminal having the above features, since rotational movements of the terminal and the other terminal piled thereon when screwing a fixing bolt are regulated by the first and second bent portions, fixing operation of the terminals can be conducted with one hand, thereby the operation become remarkably easy. Further, it is possible to prevent a looseness of the nut and bolt and a disorder of the wiring directions of the wires which are caused by rotation of the terminals after fixed. Furthermore, the terminal can be formed by a press working of a metal sheet material, it can be possible to produce the terminal with low cost.

It will be apparent from the foregoing description that the crimp-style terminal of the present invention has a number of advantages, some of which have been described above. Also, obvious modifications and variations can be made to the terminal of the present invention without departing from the scope of the invention. Accordingly, the scope of the invention is not limited as necessitated by the accompanying claims.

What is claimed is:

1. A crimp-style terminal fixed to an electrical connection with a screw together with at least one other terminal overlaid on the crimp-style terminal, wherein the screw defines a common axis of connection of the crimp-style terminals, the electrical connection and the at least one other terminal, which comprises;

an electrial contacting section with an aperture for receiving said screw;

a wire connecting section to which a wire is connected;

first means for preventing a rotation of the crimp-style terminal about the common axis of connection of the crimp-style terminal and the electrical connection; and second means for preventing a rotation of the at least one other terminal about the common axis of connection of the at least one other terminal and the crimp-style terminal, whereby the rotation of the crimp-style terminal and the overlaid terminal with respect to the electrical connection about the common axis of connection when they are fixed with the screw can be prevented;

said electrical contacting section having two sides wherein said electrical contacting section has a pair of elongated portions integrally provided on the both sides, respectively, and said first rotation preventing means comprises a pair of first bent portions formed by bending said elongated portions substantially at a right angle with respect to the electrical contacting section and said second rotation preventing means comprises a pair of second bent portions bent to the opposite side of said first bent portions.

2. A crimp-style terminal as set forth in claim 1, wherein said crimp-style terminal further comprises a neck portion formed between the electrical contacting section and the wire connecting section, and said second bent portions are formed from a pair of projections integrally formed on the neck portion.

3. A crimp-style terminal as set forth in claim 2, wherein said terminal is formed by press working of a metal sheet material.

4. A crimp-style terminal as set forth in claim 2, wherein said connection is a bar of an electrical source having an end portion, and the width of the first bent portions is slightly wider than the width of the end portion whereby the crimp-style terminal can be non-rotatably engaged with the bar.

5. A crimp-style terminal as set forth in claim 4, wherein said terminal is formed by press working of a metal sheet material.

6. A crimp-style terminal as set forth in claim 4, wherein the other terminal comprises an electrical contacting section with an aperture for the screw, a wire connecting section to which a wire is connected and a neck portion formed therebetween, and the width of the second bent portions is relatively wider than that of the neck portion of the other terminal, whereby the rotational movement of the other terminal when screwed is regulated by the second bent portions.

7. A crimp-style terminal as set forth in claim 6, wherein said terminal is formed by press working of a metal sheet material.

8. A crimp-style terminal as set forth in claim 6, wherein the second bent portions have sufficient height for regulating rotational movements of the other terminals piled thereon.

9. A crimp-style terminal as set forth in claim 8, wherein said terminal is formed by press working of a metal sheet material.

10. A crimp-style terminal as set forth in claim 1, wherein said terminal is formed by press working of a metal sheet material.

11. A crimp-style terminal as set forth in claim 1, wherein additional two rotation preventing means are provided on the both sides of the electrical contacting section.

12. A crimp-style terminal as set forth in claim 11, wherein said terminal is formed by press working of a metal sheet material.

13. A crimp-style terminal as set forth in claim 11, wherein further one rotation preventing means is provided on the electrical contacting section on the opposite side of the wire connecting section.

14. A crimp-style terminal as set forth in claim 13, wherein said terminal is formed by press working of a metal sheet material.

* * * * *